US007848924B2

(12) United States Patent
Nurminen et al.

(10) Patent No.: US 7,848,924 B2
(45) Date of Patent: Dec. 7, 2010

(54) METHOD, APPARATUS AND COMPUTER PROGRAM PRODUCT FOR PROVIDING VOICE CONVERSION USING TEMPORAL DYNAMIC FEATURES

(75) Inventors: Jani K. Nurminen, Lempaala (FI); Victor Popa, Tampere (FI); Jilei Tian, Tampere (FI)

(73) Assignee: Nokia Corporation, Espoo (FI)

( * ) Notice: Subject to any disclaimer, the term of this patent is extended or adjusted under 35 U.S.C. 154(b) by 883 days.

(21) Appl. No.: 11/788,263

(22) Filed: Apr. 17, 2007

(65) Prior Publication Data

US 2008/0262838 A1 Oct. 23, 2008

(51) Int. Cl.
*G10L 21/00* (2006.01)

(52) U.S. Cl. ..... 704/222

(58) Field of Classification Search ..... 704/222
See application file for complete search history.

(56) References Cited

U.S. PATENT DOCUMENTS 7,480,641 B2 * 1/2009 Tian et al. ..... 706/15
7,505,950 B2 * 3/2009 Tian et al. ..... 706/45

OTHER PUBLICATIONS

Jani Nurminen, Jilei Tian, Victor Popa; *Novel Method for Data Clustering and Mode Selection with Application in Voice Conversion*; Sep. 17-21, 2006; Pittsburgh, Pennsylvania.
Sarel Van Vuuren; *Speaker Verification in a Time-Feature Space*; Oregon Graduate Institute of Science and Technology, Mar. 1999.
Takashi Masuko; *HMM-Based Speech Synthesis and its Applications*; Nov. 2002.
Jesse C. Hansen; *Modulation Based Parameters for Automatic Speech Recognition*; University of Rhode Island, 2003.
Tokuda et al., "Speech Parameter Generation from HMM Using Dynamic Features," *Proceedings from the International Conference on Acoustics, Speech, and Signal Processing*, May 9-12, 1995, vol. 1, pp. 660-663.
Masuko et al., "Speech Synthesis Using HMMs with Dynamic Features," *Proceedings from the International Conference on Acoustics, Speech, and Signal Processing*, May 7-10, 1996, vol. 1, pp. 389-392.
Toda et al., "Acoustic-to-Articulatory Inversion Mapping with Gaussian Mixture Model," *Proceedings from Interspeech 2004—ICSLP 8th International Conference on Spoken Language Processing*, Oct. 4-8, 2004, pp. 1129-1132.
Turk et al., "Robust Processing Techniques for Voice Conversion," *Computer Speech & Language*, vol. 20, Issue 4, Oct. 2006, pp. 441-467. (Abstract only).

* cited by examiner

*Primary Examiner*—Susan McFadden
(74) *Attorney, Agent, or Firm*—Alston & Bird LLP

(57) ABSTRACT

An apparatus for providing voice conversion using temporal dynamic features includes a feature extractor and a transformation element. The feature extractor may be configured to extract dynamic feature vectors from source speech. The transformation element may be in communication with the feature extractor and configured to apply a first conversion function to a signal including the extracted dynamic feature vectors to produce converted dynamic feature vectors. The first conversion function may have been trained using at least dynamic feature data associated with training source speech and training target speech. The transformation element may be further configured to produce converted speech based on an output of applying the first conversion function.

23 Claims, 5 Drawing Sheets

METHOD, APPARATUS AND COMPUTER PROGRAM PRODUCT FOR PROVIDING VOICE CONVERSION USING TEMPORAL DYNAMIC FEATURES

TECHNOLOGICAL FIELD

Embodiments of the present invention relate generally to voice conversion and, more particularly, relate to a method, apparatus, and computer program product for providing enhanced voice conversion using temporal dynamic features.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to the delivery of services to a user of a mobile terminal. The services may be in the form of a particular media or communication application desired by the user, such as a music player, a game player, an electronic book, short messages, email, etc. The services may also be in the form of interactive applications in which the user may respond to a network device in order to perform a task or achieve a goal. The services may be provided from a network server or other network device, or even from the mobile terminal such as, for example, a mobile telephone, a mobile television, a mobile gaming system, etc.

In many applications, it is necessary for the user to receive audio information such as oral feedback or instructions from the network. An example of such an application may be paying a bill, ordering a program, receiving driving instructions, etc. Furthermore, in some services, such as audio books, for example, the application is based almost entirely on receiving audio information. It is becoming more common for such audio information to be provided by computer generated voices. Accordingly, the user's experience in using such applications will largely depend on the quality and naturalness of the computer generated voice. As a result, much research and development has gone into speech processing techniques in an effort to improve the quality and naturalness of computer generated voices.

Examples of speech processing include speech coding and voice conversion related applications. Voice conversion is a technique that can be used to effectively modify the speech of a source speaker in such a way that it sounds as if it was spoken by a different target speaker. Gaussian mixture models (GMMs) have been found to offer a good approach for performing transformations from source speech to target speech. More precisely, the combination of source vectors extracted from the source speech and target vectors extracted from the target speech may be used to estimate the GMM parameters for the joint density. A GMM-based conversion function may be used to minimize the mean squared error between converted vectors and target vectors.

Recently, the interest in voice conversion has risen immensely at least in part due to its application to the cost-efficient individualization of text-to-speech (TTS) systems. Another common application for voice conversion has involved use in speech-to-speech translation, where a standard voice of a text-to-speech module speaking a target language is converted to a source language of an input speaker. There are also many other potential applications for voice conversion, e.g. in entertainment applications and games.

Conventional voice conversion techniques convert feature vectors from the source speaker to match the characteristics of the target speaker on a frame by frame basis. Thus, temporal information is not typically utilized and the timing structure across multiple frames is not well addressed. As a result, the quality of voice conversion is compromised and the output of voice conversion techniques may be perceived as lacking naturalness or smoothness. Thus, a need exists for providing a mechanism for improving the quality and naturalness of speech produced as a result of voice conversion.

BRIEF SUMMARY

A method, apparatus and computer program product are therefore provided to improve voice conversion. In particular, a method, apparatus and computer program product are provided that utilizes temporal dynamic features in source and target speech in order to improve speech conversion. Accordingly, one or more models may be trained to account for both static and temporal or dynamic features of speech so that when input data is received, for example, a conversion of the input data can be made using a model or models that incorporate temporal features into speech conversion during the process of synthesizing the speech. Accordingly, an improved quality and naturalness of converted speech may be realized.

In one exemplary embodiment, a method of using dynamic features in speech conversion is provided. The method may include extracting dynamic feature vectors from source speech and applying a conversion function to a signal including the extracted dynamic feature vectors to produce converted dynamic feature vectors. The conversion function may have been trained using at least dynamic feature data associated with training source speech and training target speech. The method may further include producing converted speech based on an output of applying the first conversion function.

In another exemplary embodiment, a computer program product for using dynamic features in speech conversion is provided. The computer program product includes at least one computer-readable storage medium having computer-readable program code portions stored therein. The computer-readable program code portions include first, second and third executable portions. The first executable portion is for extracting dynamic feature vectors from source speech. The second executable portion is for applying a first conversion function to a signal including the extracted dynamic feature vectors to produce converted dynamic feature vectors. The first conversion function may have been trained using at least dynamic feature data associated with training source speech and training target speech. The third executable portion is for producing converted speech based on an output of applying the first conversion function.

In another exemplary embodiment, an apparatus for using dynamic features in speech conversion is provided. The apparatus may include a feature extractor and a transformation element. The feature extractor may be configured to extract dynamic feature vectors from source speech. The transformation element may be in communication with the feature extractor and configured to apply a first conversion function to a signal including the extracted dynamic feature vectors to produce converted dynamic feature vectors. The first conversion function may have been trained using at least dynamic feature data associated with training source speech and training target speech. The transformation element may be further configured to produce converted speech based on an output of applying the first conversion function.

In another exemplary embodiment, an apparatus for using dynamic features in speech conversion is provided. The apparatus includes means for extracting dynamic feature vectors from source speech and means for applying a first conversion function to a signal including the extracted dynamic feature vectors to produce converted dynamic feature vectors. The first conversion function may have been trained using at least dynamic feature data associated with training source speech and training target speech. The apparatus may also include means for producing converted speech based on an output of applying the first conversion function.

Embodiments of the invention may provide a method, apparatus and computer program product for employment in a speech processing or any transformation task related environment. As a result, for example, mobile terminal users may enjoy improved capabilities with respect to speech processing by introducing dynamic features to enhance the temporal structure of the converted speech to improve the quality of voice conversion.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

Figure 1:
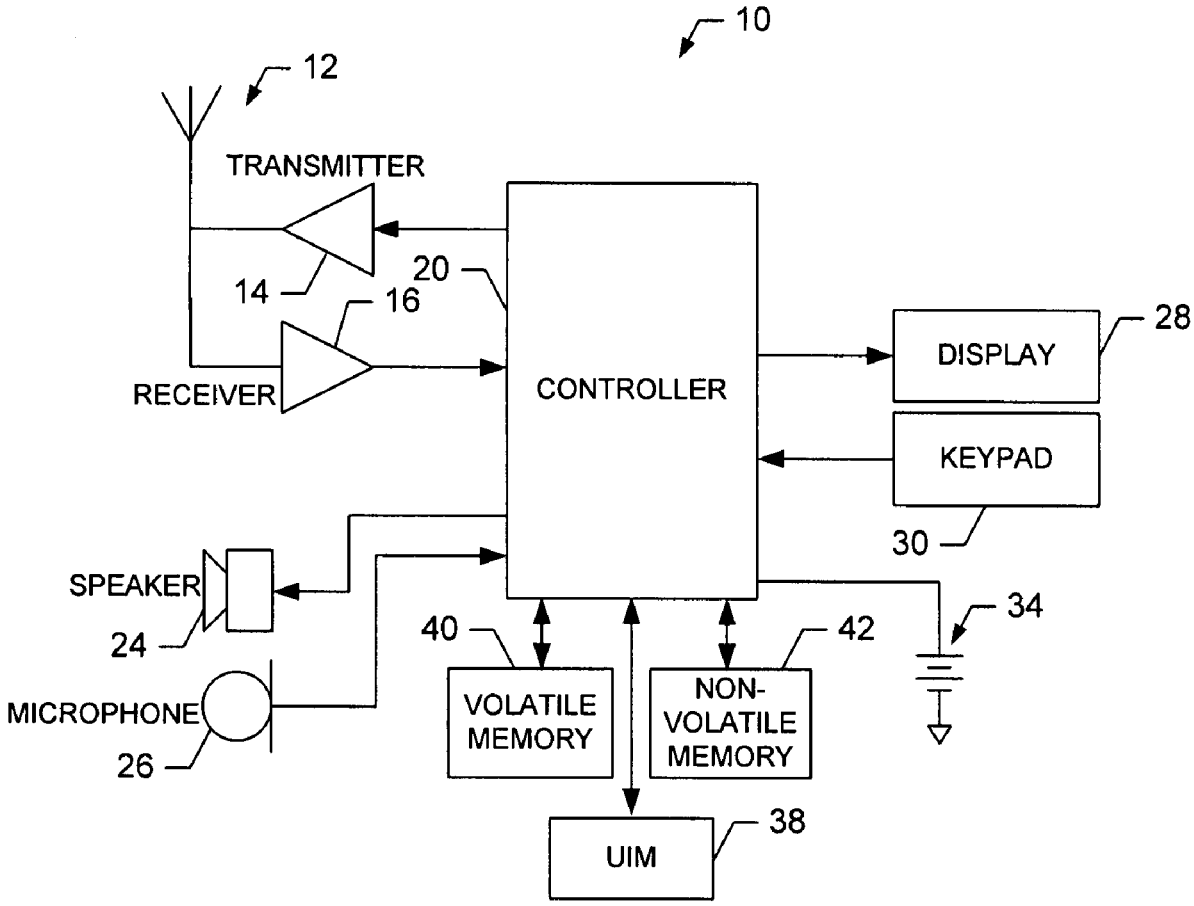
FIG. 1 is a schematic block diagram of a mobile terminal according to an exemplary embodiment of the present invention.

Embodiments of the present invention will now be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

FIG. 1 illustrates a block diagram of a mobile terminal 10 that would benefit from embodiments of the present invention. It should be understood, however, that a mobile telephone as illustrated and hereinafter described is merely illustrative of one type of mobile terminal that would benefit from embodiments of the present invention and, therefore, should not be taken to limit the scope of embodiments of the present invention. While one embodiment of the mobile terminal 10 is illustrated and will be hereinafter described for purposes of example, other types of mobile terminals, such as portable digital assistants (PDAs), pagers, mobile computers, mobile televisions, gaming devices, laptop computers, cameras, video recorders, GPS devices and other types of voice and text communications systems, can readily employ embodiments of the present invention. Furthermore, devices that are not mobile may also readily employ embodiments of the present invention.

The system and method of embodiments of the present invention will be primarily described below in conjunction with mobile communications applications. However, it should be understood that the system and method of embodiments of the present invention can be utilized in conjunction with a variety of other applications, both in the mobile communications industries and outside of the mobile communications industries.

The mobile terminal 10 includes an antenna 12 (or multiple antennae) in operable communication with a transmitter 14 and a receiver 16. The mobile terminal 10 further includes a controller 20 or other processing element that provides signals to and receives signals from the transmitter 14 and receiver 16, respectively. The signals include signaling information in accordance with the air interface standard of the applicable cellular system, and also user speech, received data and/or user generated data. In this regard, the mobile terminal 10 is capable of operating with one or more air interface standards, communication protocols, modulation types, and access types. By way of illustration, the mobile terminal 10 is capable of operating in accordance with any of a number of first, second, third and/or fourth-generation communication protocols or the like. For example, the mobile terminal 10 may be capable of operating in accordance with second-generation (2G) wireless communication protocols IS-136 (TDMA), GSM, and IS-95 (CDMA), or with third-generation (3G) wireless communication protocols, such as UMTS, CDMA2000, WCDMA and TD-SCDMA, with fourth-generation (4G) wireless communication protocols or the like.

It is understood that the controller 20 includes circuitry desirable for implementing audio and logic functions of the mobile terminal 10. For example, the controller 20 may be comprised of a digital signal processor device, a microprocessor device, and various analog to digital converters, digital to analog converters, and other support circuits. Control and signal processing functions of the mobile terminal 10 are allocated between these devices according to their respective capabilities. The controller 20 thus may also include the functionality to convolutionally encode and interleave message and data prior to modulation and transmission. The controller 20 can additionally include an internal voice coder, and may include an internal data modem. Further, the controller 20 may include functionality to operate one or more software programs, which may be stored in memory. For example, the controller 20 may be capable of operating a connectivity program, such as a conventional Web browser. The connectivity program may then allow the mobile terminal 10 to transmit and receive Web content, such as location-based content and/or other web page content, according to a Wireless Application Protocol (WAP), Hypertext Transfer Protocol (HTTP) and/or the like, for example.

The mobile terminal 10 may also comprise a user interface including an output device such as a conventional earphone or speaker 24, a microphone 26, a display 28, and a user input interface, all of which are coupled to the controller 20. The user input interface, which allows the mobile terminal 10 to receive data, may include any of a number of devices allowing the mobile terminal 10 to receive data, such as a keypad 30, a touch display (not shown) or other input device. In embodiments including the keypad 30, the keypad 30 may include the conventional numeric (0-9) and related keys (#, *), and other keys used for operating the mobile terminal 10. Alternatively, the keypad 30 may include a conventional QWERTY keypad arrangement. The keypad 30 may also include various soft keys with associated functions. In addition, or alternatively, the mobile terminal 10 may include an interface device such as a joystick or other user input interface. The mobile terminal 10 further includes a battery 34, such as a vibrating battery pack, for powering various circuits that are required to operate the mobile terminal 10, as well as optionally providing mechanical vibration as a detectable output.

The mobile terminal 10 may further include a user identity module (UIM) 38. The UIM 38 is typically a memory device having a processor built in. The UIM 38 may include, for example, a subscriber identity module (SIM), a universal integrated circuit card (UICC), a universal subscriber identity module (USIM), a removable user identity module (R-UIM), etc. The UIM 38 typically stores information elements related to a mobile subscriber. In addition to the UIM 38, the mobile terminal 10 may be equipped with memory. For example, the mobile terminal 10 may include volatile memory 40, such as volatile Random Access Memory (RAM) including a cache area for the temporary storage of data. The mobile terminal 10 may also include other non-volatile memory 42, which can be embedded and/or may be removable. The non-volatile memory 42 can additionally or alternatively comprise an EEPROM, flash memory or the like, such as that available from the SanDisk Corporation of Sunnyvale, Calif., or Lexar Media Inc. of Fremont, Calif. The memories can store any of a number of pieces of information, and data, used by the mobile terminal 10 to implement the functions of the mobile terminal 10. For example, the memories can include an identifier, such as an international mobile equipment identification (IMEI) code, capable of uniquely identifying the mobile terminal 10.

Figure 2:
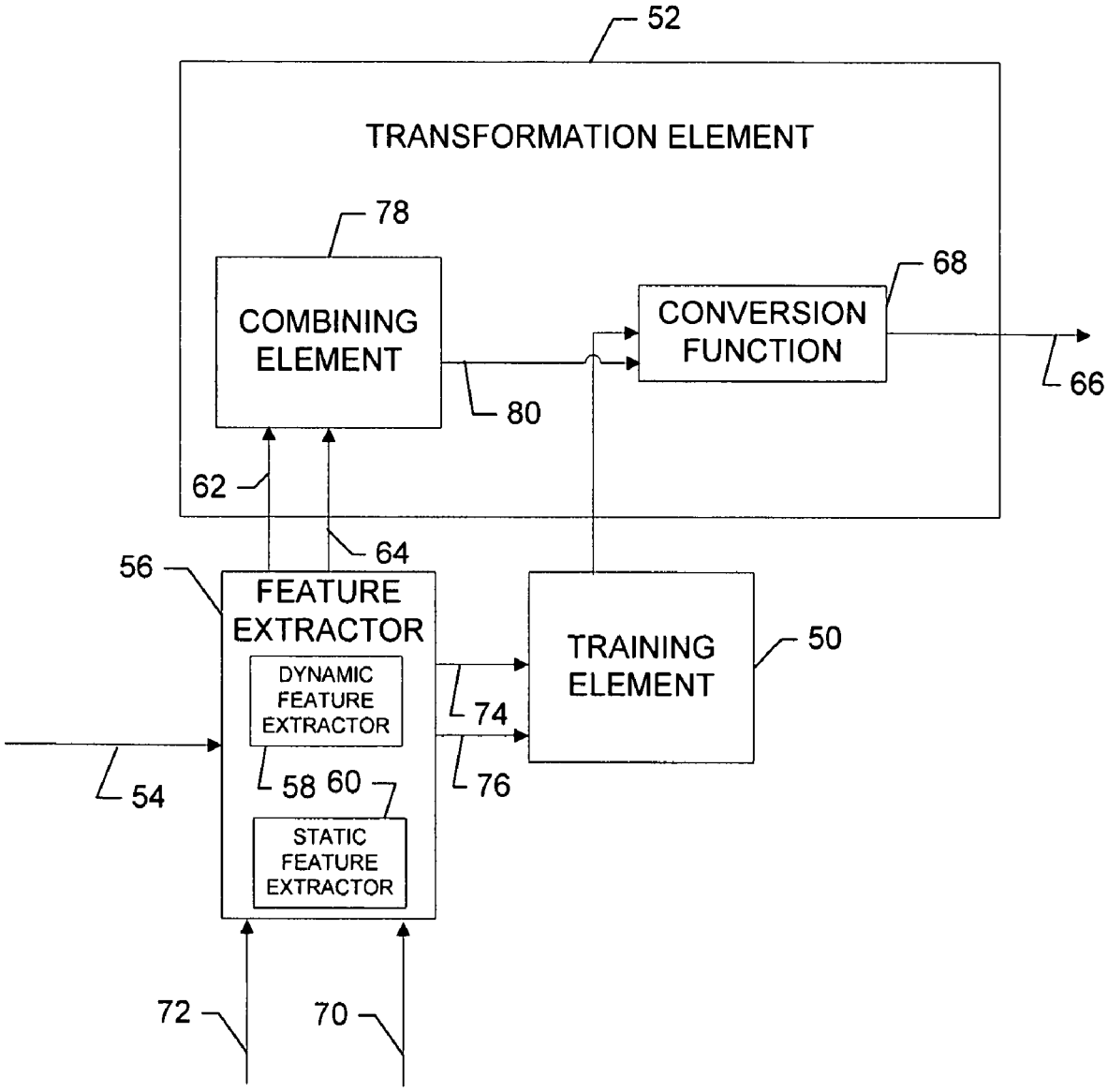
FIG. 2 is a schematic block diagram of a configuration of an apparatus for providing voice conversion using temporal dynamic features according to an exemplary embodiment of the present invention.

An exemplary embodiment of the invention will now be described with reference to FIG. 2, in which certain elements of an apparatus for providing voice conversion are displayed. The system of FIG. 2 may be employed, for example, on the mobile terminal 10 of FIG. 1. However, it should be noted that the system of FIG. 2, may also be employed on a variety of other devices, both mobile and fixed, and therefore, the present invention should not be limited to application on devices such as the mobile terminal 10 of FIG. 1. It should also be noted that while FIG. 2 illustrates one example of a configuration of an apparatus for providing voice conversion using temporal dynamic features, numerous other configurations may also be used to implement embodiments of the present invention. Furthermore, although FIG. 2 will be described in the context of a text-to-speech (TTS) conversion to illustrate an exemplary embodiment in which speech conversion using Gaussian Mixture Models (GMMs) is practiced, embodiments of the present invention need not necessarily be practiced in the context of TTS, but instead apply to any speech processing and, more generally, to data processing. Thus, embodiments of the present invention may also be practiced in other exemplary applications such as, for example, in the context of voice or sound generation in gaming devices, voice conversion in chatting or other applications in which it is desirable to hide the identity of the speaker, translation applications, speech coding, etc. Additionally, voice conversion may be performed using modeling techniques other than GMMs.

Referring now to FIG. 2, an apparatus for providing voice conversion using temporal dynamic features is provided. The apparatus includes a training element 50 and a transformation element 52. Each of the training element 50 and the transformation element 52 may be any device or means embodied in either hardware, software, or a combination of hardware and software capable of performing the respective functions associated with each of the corresponding elements as described below. In an exemplary embodiment, the training element 50 and the transformation element 52 may be embodied in software as instructions that are stored on a memory of a device such as the mobile terminal 10 and executed by a processing element such as the controller 20. However, each of the elements above may alternatively operate under the control of a corresponding local processing element or a processing element of another device not shown in FIG. 2. A processing element such as those described above may be embodied in many ways. For example, the processing element may be embodied as a processor, a coprocessor, a controller or various other processing means or devices including integrated circuits such as, for example, an ASIC (application specific integrated circuit).

It should be noted that although FIG. 2 illustrates the training element 50 as being a separate element from the transformation element 52, the training element 50 and the transformation element 52 may also be collocated or embodied in a single element or device capable of performing the functions of both the training element 50 and the transformation element 52. Additionally, as stated above, embodiments of the present invention are not limited to TTS applications. Accordingly, any device or means capable of producing a data input for transformation, conversion, compression, etc., including, but not limited to, data inputs associated with the exemplary applications listed above are envisioned as providing a data source such as source speech 54 for the apparatus of FIG. 2. Thus, for example, the source speech 54 could be provided by a live person speaking in real time, a previously recorded sample of speech, or the like.

According to the present exemplary embodiment, a TTS element capable of producing synthesized speech from computer text may provide the source speech 54. The source speech 54 may then be communicated to a feature extractor 56 capable of extracting data corresponding to a particular feature or property from a data set. In an exemplary embodiment, the feature extractor 56 may include at least a dynamic feature extraction element 58 and, in some embodiments, also a static feature extraction element 60. Each of the dynamic and static feature extraction elements 58 and 60 may be any device or means embodied in either hardware, software, or a combination of hardware and software configured to extract a corresponding one of dynamic source speech features 62 and static source speech features 64, respectively, from the source speech 54. In an exemplary embodiment, the dynamic source speech features 62 and the static source speech features 64 may be used for conversion into corresponding converted speech features 66. The converted speech features 66 may be communicated to a speech synthesizer (not shown), which may produce synthesized speech according to any method known in the art. Examples of static features may include line spectral frequency (LSF) coefficients, pitch, voicing, excitation spectrum, energy or the like. In this regard, the static features are extracted on a frame by frame basis as is known in the art. Examples of dynamic features may include a first derivative of an original feature vector (e.g., a static feature vector), acceleration in rate of speech, a second order derivative of an original feature vector, or the like, which may provide temporal structure with respect to adjacent data frames. Accordingly, the dynamic features may provide a temporal structure for associating data from the separate frames, thereby improving the quality, smoothness, and/or naturalness of resulting synthesized speech.

The transformation element 52 may be configured to transform a source speech feature (e.g., the dynamic source speech feature 62 and/or the static source speech feature 64) into a converted speech feature using a conversion function 68, which may have been previously trained using training data from the training element 50. In this regard, the transformation element 52 may be employed to include a transformation model which is essentially a trained GMM for transforming a source speech feature into the converted speech feature. In order to produce the transformation model, a GMM is trained using speech features extracted from training source speech 70 and training target speech 72 to determine a corresponding conversion function, which may then be used to transform the source speech feature into the converted speech feature by processes described below. In some embodiments, the conversion function 68 may be thought of as a function for converting from a training source speech to a training target speech with a minimal error.

In an exemplary embodiment, the training source speech 70 may be input into the feature extractor 56 in order to extract training source data 74, which may include dynamic source speech feature data and/or training static source speech feature data. The training target speech 72 may also be input into the feature extractor 56 in order to extract training target data 76, which may include training dynamic target speech feature data and/or training static target speech feature data. The training source data 74 and the training target data 76 may be communicated to the training element 50 for use in training the GMM to produce the conversion function 68. In the embodiment of FIG. 2, the training source data 74 and the training target data 76 may include combined respective components for use by the training element 50 in training a single conversion function (e.g., the conversion function 68). However, as shown in FIG. 3, for example, the training source data 74 and the training target data 76 may alternatively be processed such that the respective components are individually communicated to the training element 50 for training different respective conversion functions (e.g., a static conversion function 68' and a dynamic conversion function 68").

After the conversion function 68 has been determined through training by the training element 50, the apparatus may receive the source speech 54 at the feature extractor 56. The static feature extraction element 60 may extract static source speech features 64 and the dynamic feature extraction element 58 may extract dynamic source speech features 62. The static source speech features 64 and the dynamic source speech features 62 may include static feature vectors and dynamic feature vectors, respectively. The dynamic feature vectors and the static feature vectors may be combined at a combining element 78 to produce a general feature vector 80. The combining element 78 may be any device or means embodied in either hardware, software, or a combination of hardware and software configured to add, append or otherwise combine feature vectors such as the dynamic feature vectors and static feature vectors to form the general feature vector 80. The conversion function 68 may then be applied to the general feature vector 80 to produce corresponding converted speech as the converted speech features 66, which may be synthesized to produce improved synthetic speech.

It should be noted that although the combining element 78 of FIG. 2 is illustrated as being a portion of the transformation element 52, the combining element 78 could alternatively be a separate element. Additionally, although the feature extractor 56 is illustrated as being a separate element, the feature extractor 56 could alternatively be a portion of either of the transformation element 52 or the training element 54. It should be noted that many alternative configurations to the exemplary embodiment of FIG. 2 are possible. In this regard, FIGS. 3 and 4 are examples of alternative embodiments in which like elements are numbered the same.

Figure 3:
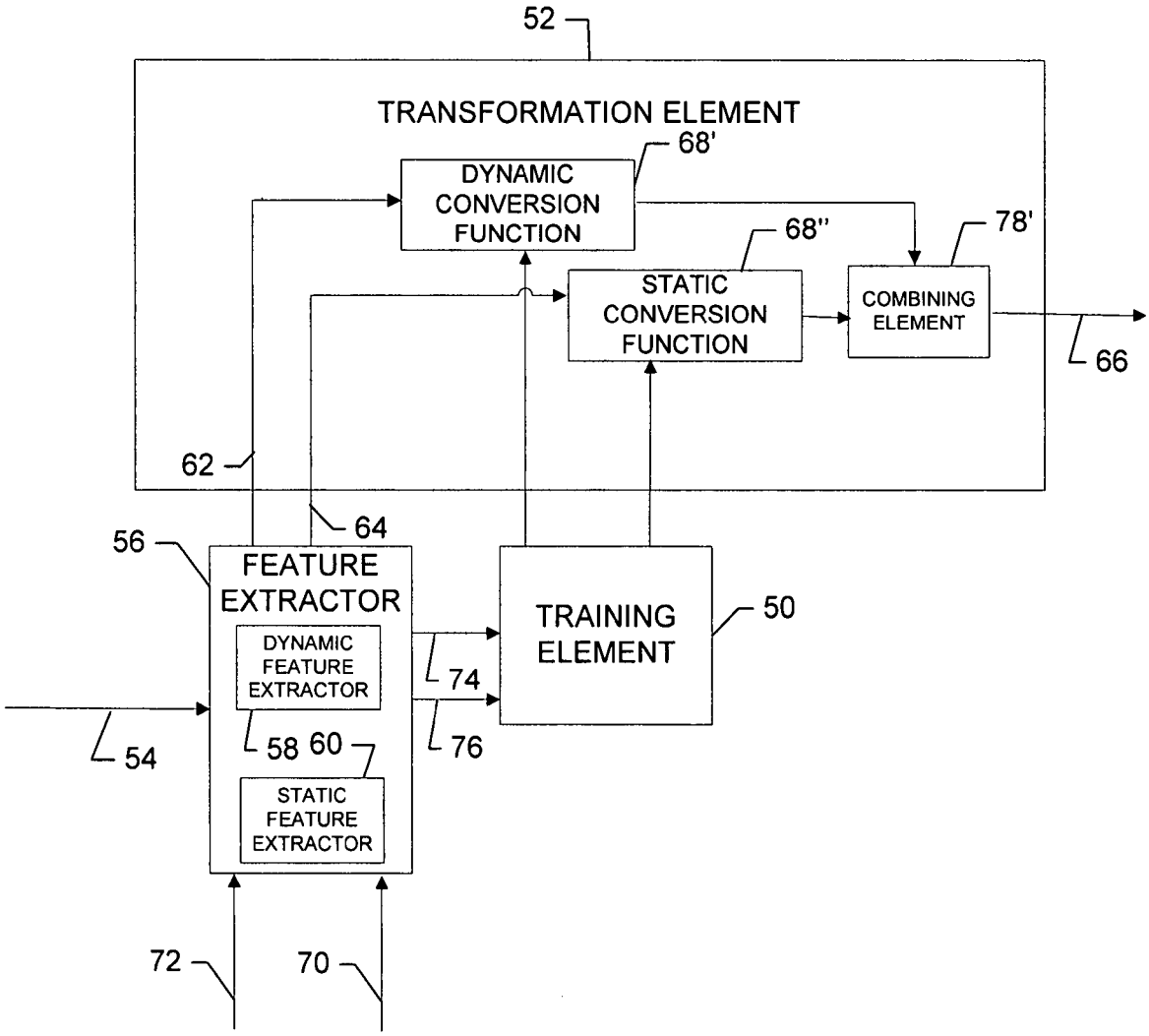
FIG. 3 is a schematic block diagram of a configuration of an apparatus for providing voice conversion using temporal dynamic features according to another exemplary embodiment of the present invention.

FIG. 3 is a schematic block diagram of a configuration of an apparatus for providing voice conversion using temporal dynamic features according to an exemplary embodiment of the present invention. In an exemplary embodiment, as shown in FIG. 3, multiple trained GMMs which may each correspond to a particular type of source speech feature (e.g., static or dynamic) may be employed for conversion. Accordingly, rather than employing the combining element 78 of FIG. 1 to create the general feature vector 80, corresponding conversion functions (e.g., the static conversion function 68' and the dynamic conversion function 68") may be applied to the static source speech features 64 and the dynamic source speech features 62, respectively. As indicated above, the static conversion function 68' and the dynamic conversion function 68" may each be trained by the training element 50 using corresponding static and dynamic training data. The output of the static conversion function 68' and the dynamic conversion function 68" may then be combined at the combining element 78', which may be similar to the combining element 78 of FIG. 2 except that the combining element 78' of FIG. 3 combines converted data and the combining element 78 of FIG. 2 combines data prior to conversion.

Figure 4:
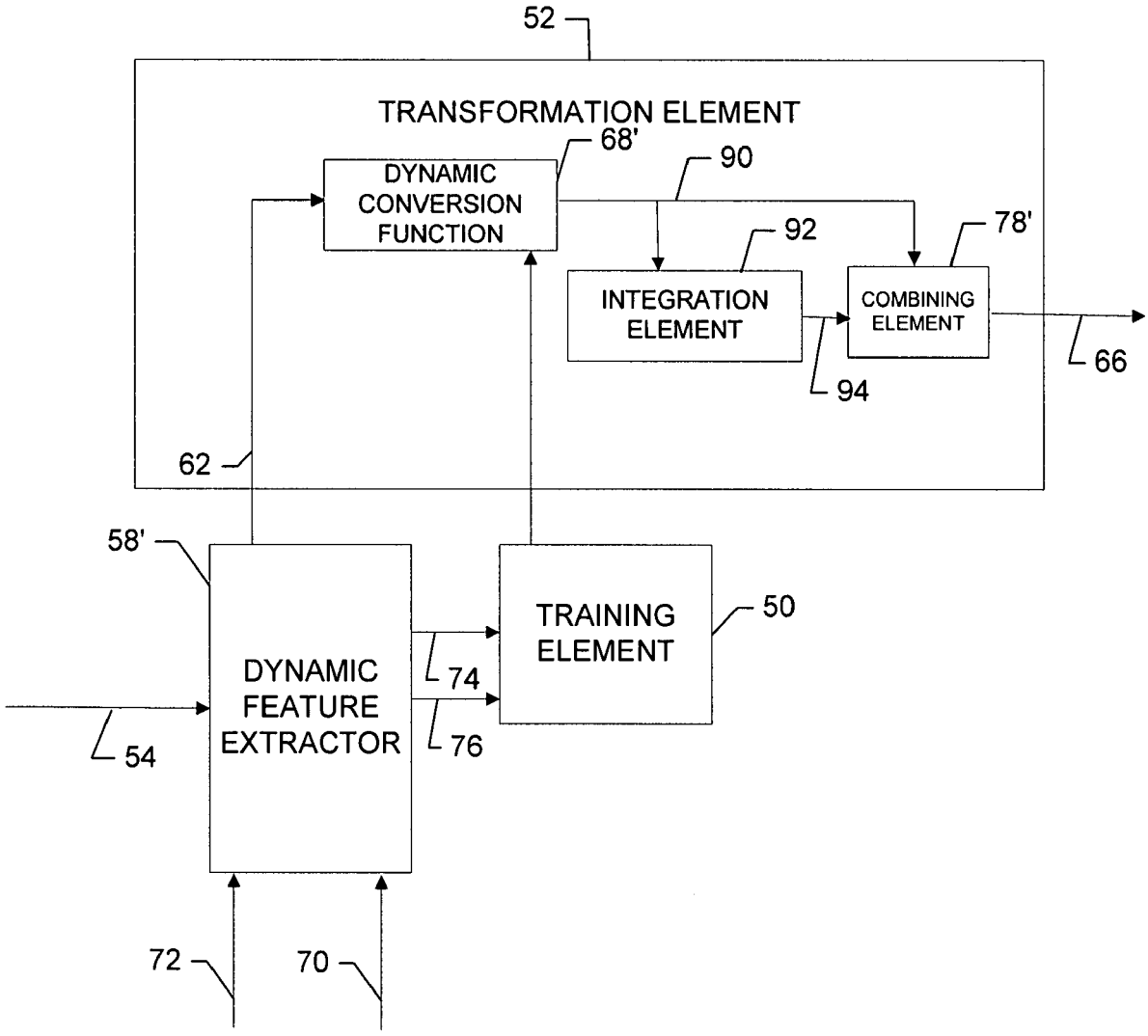
FIG. 4 is a schematic block diagram of a configuration of an apparatus for providing voice conversion using temporal dynamic features according to yet another exemplary embodiment of the present invention.

FIG. 4 is a schematic block diagram of a configuration of an apparatus for providing voice conversion using temporal dynamic features according to yet another exemplary embodiment of the present invention. As illustrated in FIG. 4, rather than utilizing multiple conversion functions and multiple feature extractors, it may be possible to utilize a single dynamic feature extractor 58', configured to extract dynamic features from the source speech 54. The training element 50 may train a single conversion function, which may be applied to the extracted dynamic features to produce converted dynamic features 90. The converted dynamic features 90 may be input into an integration element 92, which may be configured to integrate the dynamic feature data of the converted dynamic features 90 in an effort to approximate converted static features 94 associated with the source speech 54. The converted static features 94 and the converted dynamic features 90 may then be combined in the combining element 78' to produce the converted speech features 66 for synthesis into converted speech. In another exemplary embodiment, it may be possible to use only the converted dynamic features 90 in follow-on speech synthesis (e.g., without performing an explicit approximation of the converted static features).

The general descriptions of the exemplary embodiments described above in reference to FIGS. 2-4 will now be supplemented with more detailed information to illustrate exemplary embodiments. In this regard, in the context of conventional GMM based voice conversion training, consider equivalent utterances from the source and target speakers (X and Y). Through alignment, a reasonable mapping between time frames of speech data may be obtained between the source and target speakers. As such, the corresponding frames may be considered to represent equivalent acoustic events. A probability density function (PDF) of a GMM distributed random variable v can be estimated from a sequence samples of $[v_1\ v_2 \ldots v_t \ldots v_n]$ provided that a dataset is long enough as determined by one of skill in the art, by use of classical algorithms such as, for example, expectation maximization (EM). In a particular case when $v=[x^T y^T]^T$ is a joint variable, the distribution of v can serve for probabilistic mapping between the variables x and y. Thus, in an exemplary voice conversion application, x and y may correspond to similar static features from the source X and target Y speakers, respectively. For example, x and y may correspond to a line spectral frequency (LSF) vector extracted from the given short segment of the aligned speech of the source and target speaker, respectively. A static feature vector extracted from a frame of speech can consist of, for example, line spectral frequency (LSF) coefficients, pitch, voicing, excitation spectrum and energy, etc, depending on the speech model.

It should be noted that in some exemplary embodiments, all the parameters used by a particular speech model may be combined to form a feature vector. However, in alternative exemplary embodiments, it is also possible to only convert one parameter value or vector at a time, or to handle the conversion for different groups of parameters at a time. Consequently, the main steps of embodiments of the present invention may be processed more than once for a single frame of speech. Moreover, embodiments of the present invention may only be employed for some parameter(s) and other techniques may be employed with other parameters. Additionally, converted versions of all the parameters used in a speech model (and the corresponding dynamic features for all the parameters that are converted using embodiments of the present invention) may have to be available before producing the converted speech. In other words, it may not generally be possible to produce speech based on the converted speech features 66 alone in all cases, unless the feature vectors extracted from the source speech 54 contain all the parameters of the speech model.

Equations (1) and (2) below illustrate an example of a transformation from source to target parameters using a conversion function. In this regard, the distribution of v may be modeled by GMM as:

$$P(v) = P(x, y) = \sum_{l=1}^{L} c_l \cdot N\left(v, \mu_l, \sum_l\right), \tag{1}$$

where $c_l$ is the prior probability of v for the component $$l\left(\sum_{l=1}^{L} c_l = 1 \text{ and } c_l \geq 0\right),$$

in which L denotes the number of mixtures, and $N(v, \mu_l, \Sigma_l)$ denotes Gaussian distribution with the mean $\mu_l$ and the covariance matrix $\Sigma_l$. The parameters of the GMM can be estimated using the well-known expectation-maximization (EM) algorithm.

For the actual transformation, what may be desired is a function F(.) such that the transformed $F(x_t)$ best matches the target $y_t$ for all data in the training set. A conversion function that converts source feature $x_t$ to target feature $y_t$ is given by Equation (2), $$F(x_t) = E(y_t \mid x_t) = \sum_{l=1}^{L} p_l(x_t) \cdot \left(\mu_l^y + \sum_l^{yx} \left(\sum_l^{xx}\right)^{-1} (x_t - \mu_l^x)\right) \tag{2}$$

$$p_l(x_t) = \frac{\hat{c}_l \cdot N\left(x_t, \mu_l^x, \sum_l^{xx}\right)}{\sum_{i=1}^{L} c_i \cdot N(x_t, \mu_i^x, \Sigma_i^{xx})},$$

in which weighting terms $p_l(x_t)$ are chosen to be the conditional probabilities that the feature vector $x_t$ belongs to the different components of the mixture.

Equations (3) to (5) below illustrate an enhancement to the temporal structure by using dynamic features as generally described above. In this regard, let $x=[x_1\ x_2 \ldots x_t \ldots x_n]$ be the sequence of static feature vectors characterizing speech produced by the source speaker and $y=[y_1\ y_2 \ldots y_t \ldots y_n]$ be corresponding aligned static feature vectors describing the same content as produced by the target speaker, where $x_t$, $y_t$ are speech vectors at time t. The dynamic feature vectors $x_t$ and $y_t$ at time t may then be appended to the static feature vectors to form generalized feature vectors, $$x_t \Rightarrow \begin{bmatrix} x_t \\ x_t' \end{bmatrix}, \quad y_t \Rightarrow \begin{bmatrix} y_t \\ y_t' \end{bmatrix}. \tag{3}$$

The dynamic feature vectors can be estimated using several different techniques that have different accuracy and complexity tradeoffs. For example, the dynamic features can be computed using a finite impulse response (FIR) filter (e.g. high-pass filter). It is also possible to use an approximate technique for estimating the first derivative of an original feature vector, in the simplest case as follows:

$$x_t' = \frac{dx_t}{dt} \approx \sum_{i=-p}^{q} a_i \cdot x_{t-i} \approx x_t - x_{i-1}, \quad y_t' = \frac{dy_t}{dt} \approx \sum_{i=-p}^{q} a_i \cdot y_{t-i} \approx y_t - y_{t-1} \tag{4}$$

As stated above, equation (4) is one embodiment and it is also possible to use more accurate estimation techniques. Additionally, it may be possible to form estimates directly from the speech signal, at least in some cases.

A conversion function or model may be trained in a manner similar to a conventional approach, except that the feature vector may be generalized to include the dynamic feature vector as described generally above with reference to FIG. 2. As a consequence, the converted feature vector may be composed of static and dynamic parts of the converted feature vector;

$$\begin{bmatrix} c_t \\ c_t' \end{bmatrix} = F\begin{pmatrix} x_t \\ x_t' \end{pmatrix} \tag{5}$$

In the exemplary embodiment described above in reference to FIG. 2-4, a final converted static feature vector may be re-estimated from $c_t$ and $c_t'$ by optimizing an objective function:

$$Q = (1-\lambda)\cdot\|\hat{c}-c\| + \lambda\cdot\|\hat{c}'-c'\| \tag{6}$$
$$= (1-\lambda)\cdot\frac{1}{n}\cdot\sum_{t=1}^{n}(\hat{c}_t-c_t)^2 + \lambda\cdot\frac{1}{n}\cdot\sum_{t=1}^{n}(\hat{c}_t'-c_t')^2,$$

where $0 \leqq \lambda \leqq 1$ is a factor for balancing the importance of the static and dynamic features. By minimizing the objective function Q, the re-estimated converted static feature vector $\hat{c}_t$ may be achieved either using an analytical solution by solving the equation group shown in Equation (7) or by using an iterative numerical solution such as:

$$\frac{\partial Q}{\partial \hat{c}_t} = 0, \tag{7}$$
$$t = 1, \ldots, n$$
$$\therefore (1-\lambda)\cdot\sum_{t=1}^{n}(\hat{c}_t-c_t) + \lambda\cdot\sum_{t=1}^{n}\hat{c}_t''\cdot(\hat{c}_t'-c_t') = 0.$$

Finally, converted speech may be synthesized also from the re-estimated target static feature vectors $\hat{c}_t$. The synthesis can be performed using existing techniques.

In practice, an efficient algorithm may be implemented to reduce the computational complexity of the optimization step. One alternative reference solution is proposed in equations (8) to (10) below to approximately optimize the objective function defined in equation (6) with very low computational complexity.

The dynamic features can be used to recover back the static features $\hat{c}_{r,t}$ by applying dynamic-static (DS) transform. The DS transform can be implemented for example using infinite impulse response (IIR) or FIR type low pass filter. In an exemplary embodiment, the DS transform can be realized very simply as:

$$\hat{c}_{r,t} = DS(\hat{c}_t') = \tag{8}$$
$$\int_t \hat{c}_t'\cdot dt \approx \left\{\sum_{i=-P_L}^{P_H} a_i\cdot\hat{c}_{t-i}' + \sum_{i=1}^{Q} b_i\cdot\hat{c}_{r,t-i}\right\} + \alpha \approx \{\hat{c}_{r,t-1} + \hat{c}_t'\} + \alpha$$

in which constant $\alpha$ is the integral bias, which can be simply estimated, for example, by minimizing equation (9).

$$\alpha_{opt} = \underset{\alpha}{\operatorname{argmin}}\|c_t - \hat{c}_{r,t}\| \tag{9}$$

The re-estimated static feature can be efficiently calculated using $$\hat{c}_t = (1-\beta)\cdot c_t + \beta\cdot\hat{c}_{r,t}. \tag{10}$$

Factor $\beta$ can be empirically obtained to balance between static and dynamic features. Factor $\beta$ can also be made adaptively, so that it can be adjusted depending on the quality of static and dynamic features along the time. Other alternatives for obtaining the re-estimation from the static and dynamic features also exist such as, for example, using a spline based solution together with second order derivatives, etc.

Figure 5:
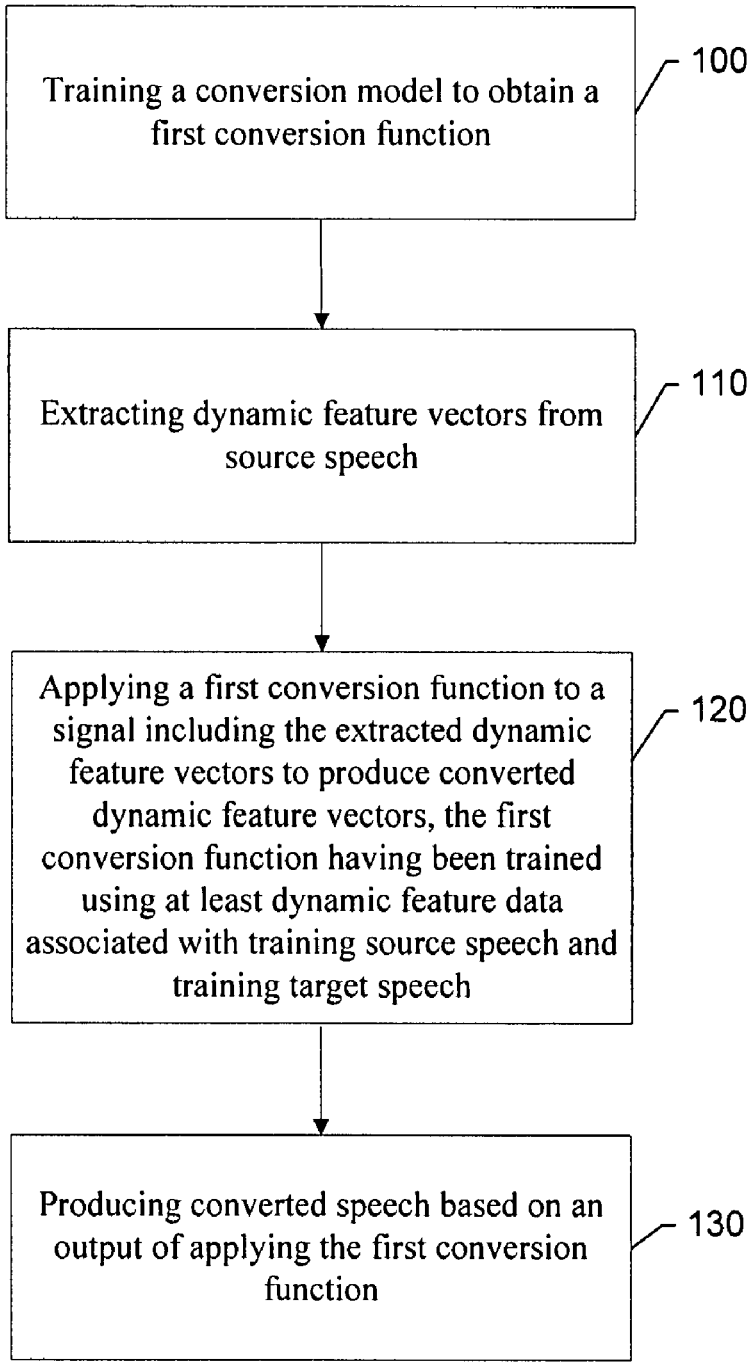
FIG. 5 is a block diagram according to another exemplary method for providing voice conversion using temporal dynamic features according to an exemplary embodiment of the present invention.

FIG. 5 is a flowchart of a method and program product according to exemplary embodiments of the invention. It will be understood that each block or step of the flowchart, and combinations of blocks in the flowchart, can be implemented by various means, such as hardware, firmware, and/or software including one or more computer program instructions. For example, one or more of the procedures described above may be embodied by computer program instructions. In this regard, the computer program instructions which embody the procedures described above may be stored by a memory device of the mobile terminal and executed by a built-in processor in the mobile terminal. As will be appreciated, any such computer program instructions may be loaded onto a computer or other programmable apparatus (i.e., hardware) to produce a machine, such that the instructions which execute on the computer or other programmable apparatus create means for implementing the functions specified in the flowcharts block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowcharts block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowcharts block(s) or step(s).

Accordingly, blocks or steps of the flowcharts support combinations of means for performing the specified functions, combinations of steps for performing the specified functions and program instruction means for performing the specified functions. It will also be understood that one or more blocks or steps of the flowcharts, and combinations of blocks or steps in the flowcharts, can be implemented by special purpose hardware-based computer systems which perform the specified functions or steps, or combinations of special purpose hardware and computer instructions.

In this regard, one embodiment of the invention, as shown in FIG. 5, may include an optional initial operation of training a conversion model to obtain a first conversion function at operation 100. In an exemplary embodiment, using an already trained conversion model or a model trained in operation 100, the method may include extracting dynamic feature vectors from source speech at operation 110. At operation 120, the first conversion function may be applied to a signal including the extracted dynamic feature vectors to produce converted dynamic feature vectors. The first conversion function may have been trained using at least dynamic feature data associated with training source speech and training target speech. Converted speech may then be produced based on an output of applying the first conversion function at operation 130.

In one exemplary embodiment, operation 100 may include extracting static and dynamic feature data from both training source data and training target data, utilizing the static feature data from both the training source data and the training target data to train a second conversion model, and utilizing the dynamic feature data from both the training source data and the training target data to train the first conversion model. In such an embodiment, applying the first conversion function may include applying the second conversion function to static feature vectors extracted from source speech, and combining an output of the first conversion function and the second conversion function for use in producing the converted speech.

In an alternative embodiment, operation 100 may include extracting static and dynamic feature data from both training source data and training target data, combining the static and dynamic feature data to form general feature data, and utilizing the general feature data to train the first conversion model.

In an exemplary embodiment, operation 130 may further include integrating a result of the applying the conversion function to estimate converted static features and combining the result of the applying the conversion function and the estimated converted static features for use in converted speech production.

In another exemplary embodiment, the method could further include operations of extracting static and dynamic feature vectors from source speech, and combining the static feature vectors and the dynamic feature vectors to produce a general feature vector. In such an embodiment, operation 120 may include applying the first conversion function to the general feature vector for use in producing the converted speech.

The above described functions may be carried out in many ways. For example, any suitable means for carrying out each of the functions described above may be employed to carry out embodiments of the invention. In one embodiment, all or a portion of the elements of the invention generally operate under control of a computer program product. The computer program product for performing the methods of embodiments of the invention includes a computer-readable storage medium, such as the non-volatile storage medium, and computer-readable program code portions, such as a series of computer instructions, embodied in the computer-readable storage medium.

Many modifications and other embodiments of the inventions set forth herein will come to mind to one skilled in the art to which these embodiments pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method comprising:

extracting, via a processor, dynamic feature vectors from source speech;

applying a first conversion function to a signal including the extracted dynamic feature vectors to produce converted dynamic feature vectors, the first conversion function having been trained using at least dynamic feature data associated with training source speech and training target speech; and producing converted speech based on an output of applying the first conversion function.

2. A method according to claim 1, further comprising an initial operation of training a conversion model to obtain the first conversion function.

3. A method according to claim 2, wherein training the conversion model comprises:

extracting static and dynamic feature data from both training source data and training target data;

utilizing the static feature data from both the training source data and the training target data to train a second conversion model; and utilizing the dynamic feature data from both the training source data and the training target data to train the first conversion model.

4. A method according to claim 3, wherein applying the first conversion function further comprises:

applying the second conversion function to static feature vectors extracted from source speech; and combining an output of the first conversion function and the second conversion function for use in producing the converted speech.

5. A method according to claim 2, wherein training the first conversion model comprises:

extracting static and dynamic feature data from both training source data and training target data;

combining the static and dynamic feature data to form general feature data; and utilizing the general feature data to train the first conversion model.

6. A method according to claim 1, wherein producing the converted speech further comprises integrating a result of the applying the conversion function to estimate converted static features and combining the result of the applying the conversion function and the estimated converted static features for use in converted speech production.

7. A method according to claim 1, further comprising:

extracting static feature vectors from source speech; and combining the static feature vectors and the dynamic feature vectors to produce a general feature vector, wherein applying the first conversion function comprises applying the first conversion function to the general feature vector for use in producing the converted speech.

8. A computer program product comprising at least one non-transitory computer-readable storage medium having computer-readable program code portions stored therein, the computer-readable program code portions comprising:

a first executable portion for extracting dynamic feature vectors from source speech;

a second executable portion for applying a first conversion function to a signal including the extracted dynamic feature vectors to produce converted dynamic feature vectors, the first conversion function having been trained using at least dynamic feature data associated with training source speech and training target speech; and a third executable portion for producing converted speech based on an output of applying the first conversion function.

9. A computer program product according to claim 8, further comprising a fourth executable portion for an initial operation of training a conversion model to obtain the first conversion function.

10. A computer program product according to claim 9, wherein the fourth executable portion includes instructions for:

extracting static and dynamic feature data from both training source data and training target data;

utilizing the static feature data from both the training source data and the training target data to train a second conversion model; and utilizing the dynamic feature data from both the training source data and the training target data to train the first conversion model.

11. A computer program product according to claim 10, wherein the second executable portion includes instructions for:

applying the second conversion function to static feature vectors extracted from source speech; and combining an output of the first conversion function and the second conversion function for use in producing the converted speech.

12. A computer program product according to claim 9, wherein the fourth executable portion includes instructions for:

extracting static and dynamic feature data from both training source data and training target data;

combining the static and dynamic feature data to form general feature data; and utilizing the general feature data to train the first conversion model.

13. A computer program product according to claim 8, wherein the third executable portion includes instructions for integrating a result of the applying the conversion function to estimate converted static features and combining the result of the applying the conversion function and the estimated converted static features for use in converted speech production.

14. A computer program product according to claim 8, further comprising:

a fourth executable portion for extracting static feature vectors from source speech; and a fifth executable portion for combining the static feature vectors and the dynamic feature vectors to produce a general feature vector, wherein the second executable portion includes instructions for applying the first conversion function to the general feature vector for use in producing the converted speech.

15. An apparatus comprising a processor and memory including computer program code, the processor and the computer program code configured to, with the processor, cause the apparatus at least to:

extract dynamic feature vectors from source speech;

apply a first conversion function to a signal including the extracted dynamic feature vectors to produce converted dynamic feature vectors, the first conversion function having been trained using at least dynamic feature data associated with training source speech and training target speech, and produce converted speech based on an output of applying the first conversion function.

16. An apparatus according to claim 15, wherein the memory and the computer program code are further configured to, with the processor, cause the apparatus to perform an initial operation of training a conversion model to obtain the first conversion function.

17. An apparatus according to claim 16, wherein the memory and the computer program code are further configured to, with the processor, cause the apparatus to extract static and dynamic feature data from both training source data and training target data; and utilize the static feature data from both the training source data and the training target data to train a second conversion model, and to utilize the dynamic feature data from both the training source data and the training target data to train the first conversion model.

18. An apparatus according to claim 17, wherein the memory and the computer program code are further configured to, with the processor, cause the apparatus to:

apply the second conversion function to static feature vectors extracted from source speech; and combine an output of the first conversion function and an output of the second conversion function for use in producing the converted speech.

19. An apparatus according to claim 16, wherein the memory and the computer program code are further configured to, with the processor, cause the apparatus to extract static and dynamic feature data from both training source data and training target data, combine the static and dynamic feature data to form general feature data; and utilize the general feature data to train the first conversion model.

20. An apparatus according to claim 15, wherein the memory and the computer program code are further configured to, with the processor, cause the apparatus to integrate a result of applying the conversion function to estimate converted static features and combining the result of the applying the conversion function and the estimated converted static features for use in converted speech production.

21. An apparatus according to claim 15, wherein the memory and the computer program code are further configured to, with the processor, cause the apparatus to extract static feature vectors from source speech, and wherein the transformation element is configured to combine the static feature vectors and the dynamic feature vectors to produce a general feature vector, and to apply the first conversion function to the general feature vector for use in producing the converted speech.

22. An apparatus comprising:

means for extracting dynamic feature vectors from source speech;

means for applying a first conversion function to a signal including the extracted dynamic feature vectors to produce converted dynamic feature vectors, the first conversion function having been trained using at least dynamic feature data associated with training source speech and training target speech; and means for producing converted speech based on an output of applying the first conversion function.

23. An apparatus according to claim 22, further comprising means for an initial operation of training a conversion model to obtain the first conversion function.

* * * * *